US006446844B1

(12) United States Patent
Gross

(10) Patent No.: US 6,446,844 B1
(45) Date of Patent: Sep. 10, 2002

(54) CLOSURE WITH INTERNAL FLOW CONTROL FOR A PRESSURE OPENABLE VALVE IN AN EXTENDABLE/ RETRACTABLE NOZZLE

(75) Inventor: Richard A. Gross, Oconomowoc, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 10/024,832

(22) Filed: Dec. 18, 2001

(51) Int. Cl.[7] ..... B65D 35/00

(52) U.S. Cl. ..... 222/494; 222/212; 222/490; 222/492; 222/547; 222/564

(58) Field of Search ..... 222/494, 492, 222/490, 547, 212, 213, 564

(56) References Cited

U.S. PATENT DOCUMENTS

| | | | | |
|---|---|---|---|---|
| 3,273,754 | A | | 9/1966 | Lindley |
| 4,133,457 | A | | 1/1979 | Klassen |
| 4,186,882 | A | | 2/1980 | Szczepanski |
| 4,253,588 | A | | 3/1981 | Lester et al. |
| 4,349,134 | A | | 9/1982 | Schuster et al. |
| 4,408,702 | A | | 10/1983 | Horvath |
| 4,506,809 | A | | 3/1985 | Corsette |
| 4,561,570 | A | | 12/1985 | Zulauf et al. |
| 4,635,826 | A | | 1/1987 | Hatakeyama et al. |
| 4,690,304 | A | | 9/1987 | Morel |
| 4,739,906 | A | | 4/1988 | Lo Turco |
| 4,747,518 | A | | 5/1988 | Laauwe |
| 4,785,978 | A | | 11/1988 | Kano et al. |
| 4,941,598 | A | | 7/1990 | Lambelet et al. |
| 5,033,647 | A | | 7/1991 | Smith |
| 5,033,655 | A | | 7/1991 | Brown |
| 5,125,539 | A | | 6/1992 | Schneider |
| 5,143,236 | A | | 9/1992 | Gueret |
| 5,226,568 | A | | 7/1993 | Newton et al. |
| 5,267,673 | A | | 12/1993 | Crosnier et al. |
| 5,295,597 | A | | 3/1994 | Green |
| 5,325,999 | A | | 7/1994 | Gueret |
| 5,680,969 | A | * | 10/1997 | Gross ..... 222/494 |
| 5,692,651 | A | | 12/1997 | Fuchs |
| 5,743,443 | A | * | 4/1998 | Hins ..... 222/490 |
| 5,782,386 | A | | 7/1998 | Lester |
| 5,803,314 | A | | 9/1998 | Lester |
| 5,839,626 | A | | 11/1998 | Gross et al. |
| 5,897,033 | A | | 4/1999 | Okawa et al. |
| 5,934,514 | A | | 8/1999 | Lampe et al. |
| 5,938,086 | A | | 8/1999 | Gross |
| 5,950,878 | A | | 9/1999 | Wade et al. |
| 6,095,382 | A | | 8/2000 | Gross |
| 6,176,399 | B1 | | 1/2001 | Schantz et al. |
| 6,290,108 | B1 | * | 9/2001 | Gross ..... 222/494 |

OTHER PUBLICATIONS

U.S. patent application Ser. No.09/502,630, filed Feb. 11, 2000.

U.S. patent application Ser. No. 09/747,745, filed Dec. 20, 2000.

* cited by examiner

*Primary Examiner*—Lesley D. Morris
*Assistant Examiner*—Thach H. Bui
(74) *Attorney, Agent, or Firm*—Wood, Phillips, Katz. Clark & Mortimer

(57) ABSTRACT

A dispensing system is provided for dispensing a product from a container having an opening. The dispensing system includes a spout for communicating with the container opening. The spout defines at least one discharge aperture and a distal seal. A nozzle assembly is mounted on the spout for movement between a retracted, closed position and an extended, open position. The nozzle assembly includes a nozzle having a dispensing passage around at least a portion of the spout. The nozzle assembly also includes a resiliently flexible valve that is sealingly disposed across the nozzle dispensing passage at a location distally of the spout and has an initially closed dispensing orifice which opens in response to a pressure differential acting across the valve. The nozzle assembly also includes a flow restrictor below the valve, and a distal seal for sealingly engaging the spout distal seal.

20 Claims, 9 Drawing Sheets

CLOSURE WITH INTERNAL FLOW CONTROL FOR A PRESSURE OPENABLE VALVE IN AN EXTENDABLE/ RETRACTABLE NOZZLE

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to a system for dispensing a product from a container. The system is especially suitable for use as part of, or as a dispensing closure for, a flexible container which is squeezable.

BACKGROUND OF THE INVENTION AND TECHNICAL PROBLEMS POSED BY THE PRIOR ART

There are a wide variety of packages which include (1) a squeezable container, (2) a dispensing system extending as a unitary part of, or attachment to, the container, and (3) a product contained within the container. One type of such a package employs a single dispensing valve for discharging a single stream of product (which may be a liquid, cream, or particulate product). See, for example, U.S. Pat. No. 5,839,614. The package includes a flexible, resilient, slit-type valve. The valve is normally closed and can withstand the weight of the product when the container is completely inverted, so that the product will not leak out unless the container is squeezed.

With some types of products, such as glue, hair coloring, condiments, and the like, it may be desirable to provide a dispensing system which can more accurately control the discharge of the product. In particular, it may be desirable to more precisely control the location of the deposit of the product and to provide a dispensing system for affording such control while at the same time permitting the user to clearly observe the product deposition location. It would also be advantageous if such an improved dispensing system could also more accurately control the direction in which the product is dispensed while at the same time providing a clear indication to the user as to the specific direction in which the product will be, or is being, dispensed.

Although a relatively long, narrow, tapered nozzle might be employed to facilitate the dispensing of a product in a way that would enable the user to more accurately control the product dispensing location and product dispensing direction, the use of such a long nozzle can create other problems. Specifically, the product within a long nozzle may continue to flow from the nozzle even after the desired amount of product has been dispensed.

For example, consider the situation when a relatively high viscosity product is being dispensed from an inverted, squeezable container through a relatively long nozzle. The long nozzle must be initially filled with fluid product as the container is inverted. The user, after inverting the container, is unable to tell exactly when the product will be discharged from the tip of the nozzle. With a relatively high viscosity product, the user will have to squeeze the container somewhat just to fill the nozzle, and the user thus cannot be sure when the nozzle has been filled and when the first drop of product will be discharging from the nozzle.

Further, when the user sees that the desired amount of product has been dispensed from the tip of the nozzle and deposited on the receiving surface, the user would typically stop squeezing the container. However, the amount of product within the nozzle may continue to flow out of the nozzle before the user can invert the container or otherwise move the system away from the dispensing location. Thus, such a system lacks the desired capability to precisely control the termination of the product flow from the nozzle.

Accordingly, it would be desirable to provide an improved dispensing system which could overcome, or at least minimize, the above-described product dispensing control problems.

It would also be desirable to provide an internal system for positively preventing flow of the product through the system regardless of the orientation of the container and regardless of whether or not the container was being squeezed or otherwise pressurized. Such an internal seal system should be easily actuatable to open the flow path when desired to accommodate the dispensing of the product and should be readily actuatable to close the flow path when desired so as to prevent inadvertent leakage of the product when the container is being shipped or stored where it might be subjected to external impact forces which could increase the pressure within the container or otherwise cause discharge of some amount of the product.

The U.S. Pat. No. 6,290,108 discloses a prior art dispensing system that includes an embodiment which has, inter alia, a long nozzle and which allows the user to (1) more easily ascertain the location where the product will be deposited, (2) more easily control the starting and stopping of the product flow out of the nozzle, and (3) employ a releasable internal seal for positively preventing flow of the product through the system regardless of the orientation of the container and regardless of whether or not the container is being squeezed or otherwise pressurized. However, when such a prior art system is employed in some applications, especially where the system has particular internal flow path dimensions and is used to dispense high viscosity fluent products (e.g., mustard or mayonnaise), there may be operational characteristics that a user might find objectionable in some situations. Potentially objectionable operational characteristics may be present in some applications because the system employs an internal seal in conjunction with a fixed spout over which is mounted a movable nozzle carrying a pressure-openable, flexible, slit type valve. The internal seal elements must first be opened (by moving the nozzle upwardly) to allow the user to squeeze the product through the pressure-openable valve. After such a prior art dispensing system has discharged a desired quantity of a high-viscosity product and the valve has re-closed, there is an accumulation of the product in the space between the top end of the spout and the closed valve. If the user then operates the system to close the internal seal by moving the nozzle (and valve carried therein) downwardly toward the spout, the squeezing of the viscous product between the downwardly moving valve and the top end of the spout may cause the valve to open so that some product flows out through the valve until the nozzle reaches the bottom end of its movement (where the internal seal is completely closed). This may be especially objectionable with a food product such as mustard or mayonnaise where a small amount of such a product would then remain on the exterior of the valve even though the user has finished dispensing the product and has manipulated the dispensing system so that the internal seal is fully closed. Thus, it would be desirable to provide an improved dispensing system which could accommodate relatively viscous products and which could be manipulated to establish a closed, internal seal in a way that causes only a minimal amount of, or no, flow through the flexible, slit valve as the dispensing system is manipulated to fully close the internal seal elements.

It would also be beneficial if an improved dispensing system could function without the need for a hinged lid which would have to be initially moved to an open position to permit dispensing and which, in the open position, could obscure a portion of the product dispensing stream or product discharge location from the user's view. It would also be desirable if such an improved dispensing system would not employ any other type of separate lid, overcap, or plug which would require removal prior to dispensing and which could become lost or misplaced.

It would also be advantageous if such an improved system could accommodate bottles, containers, or packages which have a variety of shapes and that are constructed from a variety of materials.

Further, it would be desirable if such an improved system could accommodate efficient, high-quality, large-volume manufacturing techniques with a reduced product reject rate to produce a system with consistent operating characteristics unit-to-unit with high reliability.

The present invention provides an improved dispensing system which can accommodate designs having the above-discussed benefits and features.

BRIEF SUMMARY OF THE INVENTION

The present invention provides a system for dispensing a product from a container in a way that can be better controlled by the user. The system can accommodate the discharge of liquids, creams, or particulate matter, including powders. The user can more easily ascertain the location where the product will be deposited. The user can readily control the direction of product flow. Further, the starting and stopping of the product flow can be more precisely controlled. The system includes a flexible, slit valve located above internal sealing elements, and the system can be manipulated to fully close the internal seal elements in a way that causes only a minimal amount of, or no, fluid product to be discharged through the flexible, slit valve—even when the fluid product is a relatively viscous product.

The dispensing system is adapted for use in dispensing a product from a container having an opening. Some portions of the dispensing system may be formed as a unitary part of an end of such a container, or the system may be a separate assembly that is permanently or releasably attached to the container.

In a first embodiment of the invention, the dispensing system includes a spout that is adapted for communicating with the container opening and that defines (1) at least one discharge aperture having a fixed geometry at a stationary location relative to the container, and (2) a distal seal surface located distally of the discharge aperture relative to the container.

The dispensing system includes a nozzle assembly which is mounted on the spout. The nozzle assembly is movable along the spout between a retracted, closed position, and an extended, open position. The nozzle assembly includes a nozzle having (1) a dispensing passage around at least a portion of the spout, and (2) a distal seal surface for sealingly engaging the spout distal seal surface when the nozzle assembly is in the retracted, closed position.

The nozzle assembly also includes a resiliently flexible valve. The valve is sealingly disposed across the nozzle dispensing passage at a location distally of the spout distal seal surface. The valve has an initially closed dispensing orifice which opens in response to a pressure differential acting across the valve.

The first embodiment of the dispensing system also includes a flow restrictor that is disposed across the nozzle dispensing passage at a location between the valve and the nozzle distal seal surface so as to restrict flow toward the valve as the nozzle assembly is moved to the retracted, closed position.

In a second embodiment of the invention, the dispensing system includes a spout for communicating with the container opening, and the spout has a deck defining at least one discharge aperture having a fixed geometry at a stationary location relative to the container. A nozzle assembly is mounted on the spout for movement between a retracted, closed position and an extended, open position. The nozzle assembly includes (A) a nozzle having a dispensing passage around at least a portion of the spout; (B) a resiliently flexible valve that (1) is sealingly disposed across the nozzle dispensing passage at a location distally of the spout discharge aperture, and (2) has an initially closed dispensing orifice which opens in response to a pressure differential acting across the valve; and (C) a flow restrictor that is disposed across the nozzle dispensing passage at a location between the valve and the spout deck discharge aperture.

The second embodiment of the dispensing system also includes (1) a distal seal groove defined on either the spout deck or nozzle, and (2) a distal seal bead on the other of the spout deck and nozzle. The distal seal bead sealingly engages the distal seal groove when the nozzle assembly is in the retracted, closed position. The seal groove may be defined in the spout deck around the discharge aperture, and the seal bead may be defined on the flow restrictor.

A presently preferred form of the dispensing system has the valve mounted adjacent the distal tip of the nozzle. Preferably, the valve is self-sealing and is biased to close when the pressure differential across the open valve drops below a predetermined amount. Alternatively, the dispensing system can employ a valve which, once opened, remains opened even if the pressure differential across the valve drops to zero. Further, the dispensing structure of the present invention can accommodate different types of valves, as well as different sizes of valves.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DETAILED DESCRIPTION

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, most of the figures illustrating the invention show the dispensing system in the typical orientation that it would have at the top of a container when the container is stored upright on its base, and terms such as upper, lower, horizontal, etc., are used with reference to this position. It will be understood, however, that the dispensing system of this invention may be manufactured, stored, transported, used, and sold in an orientation other than the position described.

The dispensing system of this invention is suitable for use with a variety of conventional or special containers having various designs, the details of which, although not illustrated or described, would be apparent to those having skill in the art and an understanding of such containers. The container per se forms no part of the present invention.

Figure 1:
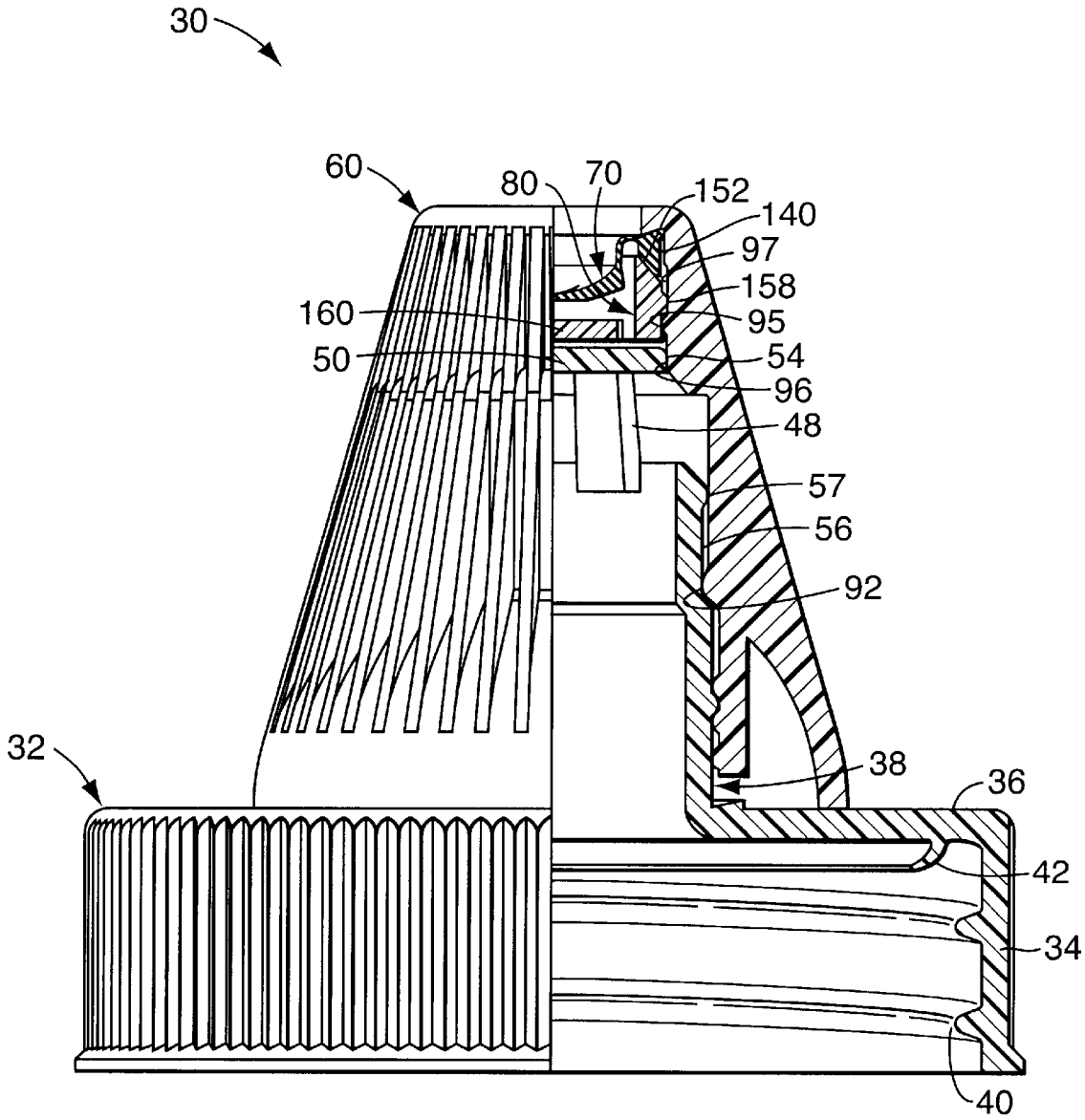
FIG. 1 is a partial, cross-sectional, side elevational view of a first embodiment of the dispensing system of the present invention as incorporated in a dispensing closure which is formed separately from, and which is adapted to be releasably mounted to, a container (not illustrated) that has an opening to the container interior, and the dispensing closure is shown with the components thereof in a closed condition.
Figure 2:
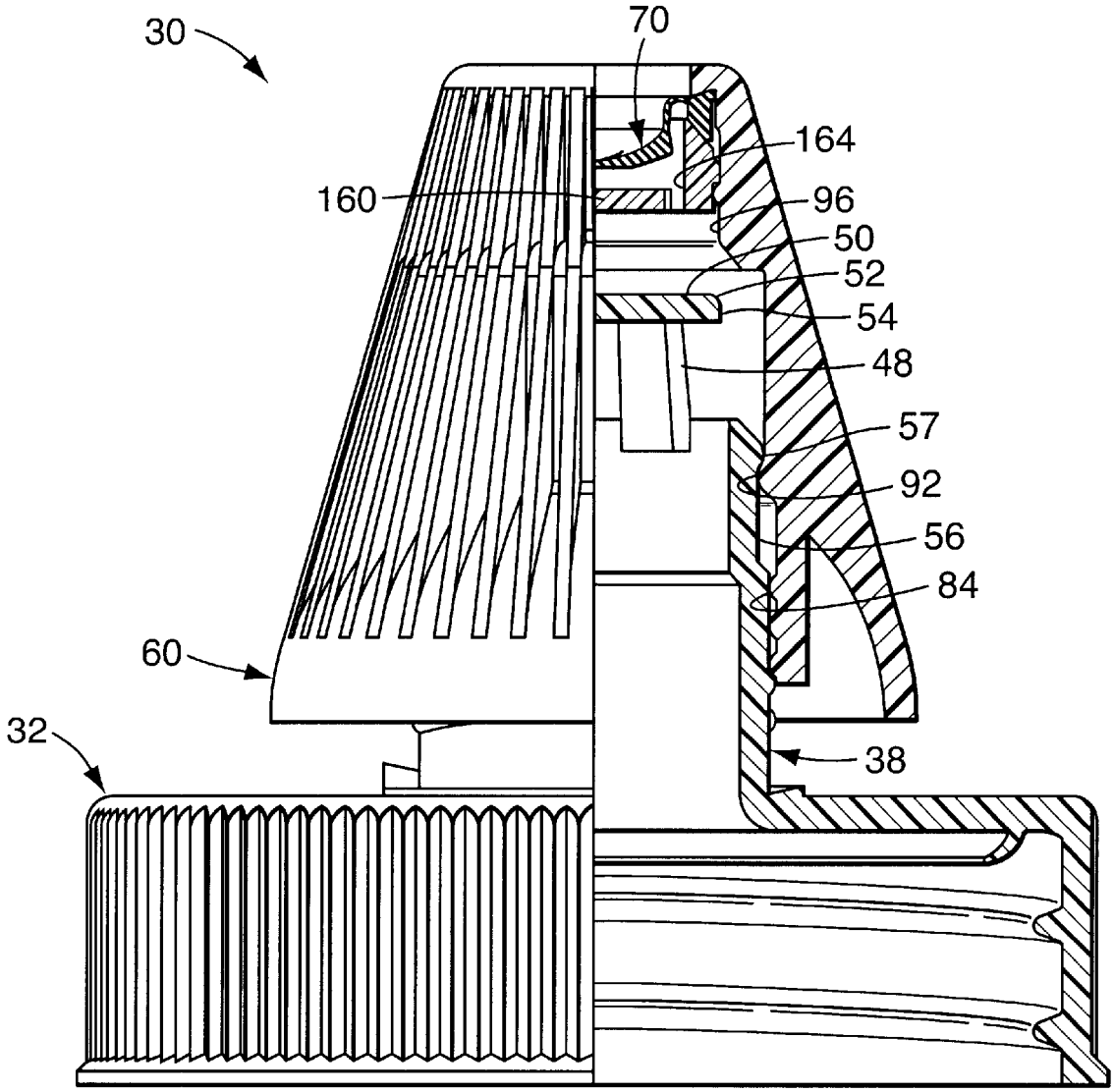
FIG. 2 is a view similar to FIG. 1, but FIG. 2 shows the dispensing closure with internal seal elements in an open condition.
Figure 3:
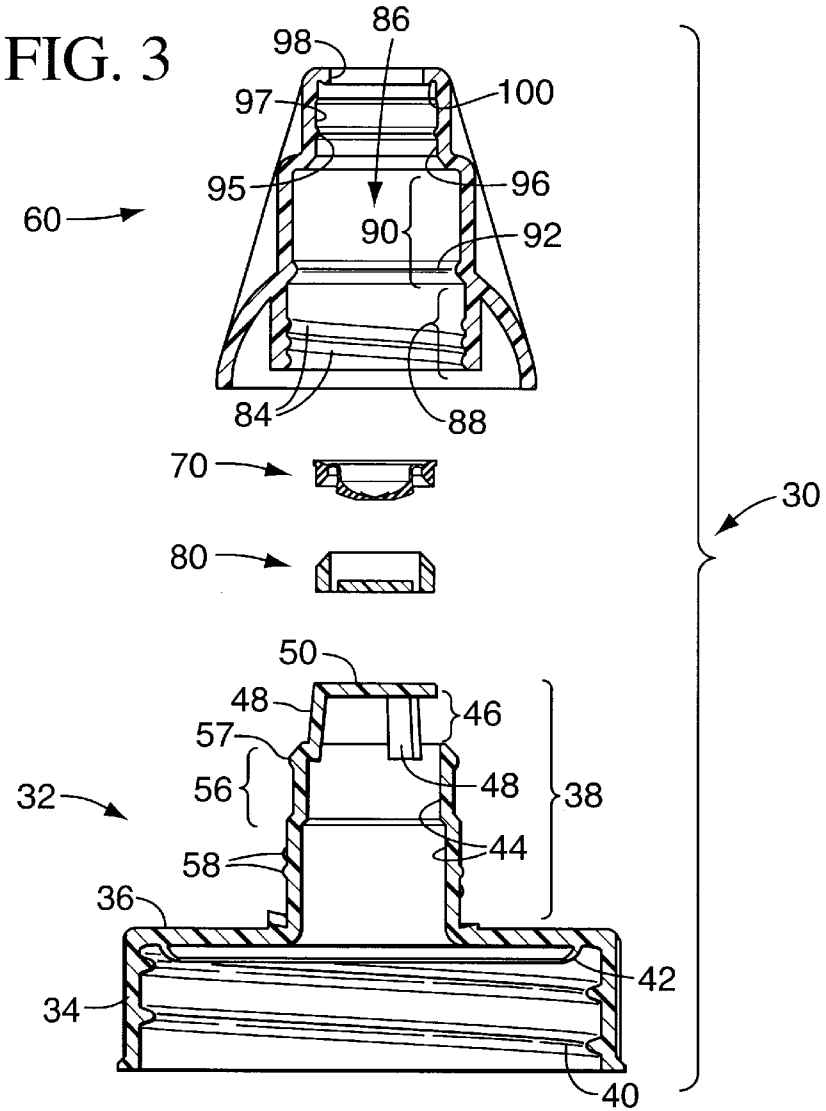
FIG. 3 is an exploded, cross-sectional view of the components of the dispensing closure shown in FIGS. 1 and 2.
Figure 7:
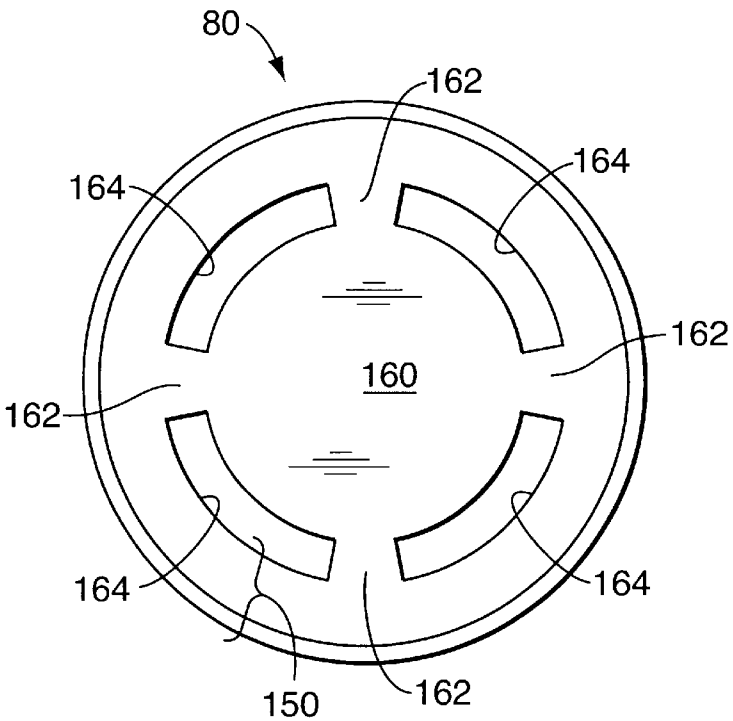
FIG. 7 is a bottom plan view of the retainer shown in FIGS. 5 and 6.
Figure 6:
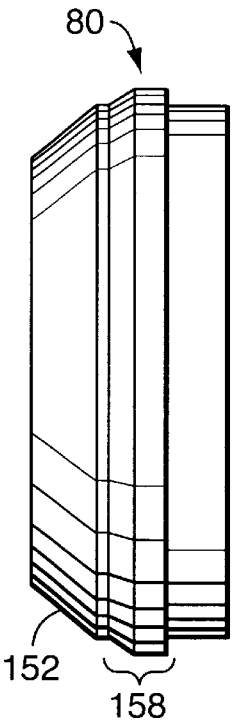
FIG. 6 is a side elevational view of the retainer shown in FIG. 5.
Figure 5:
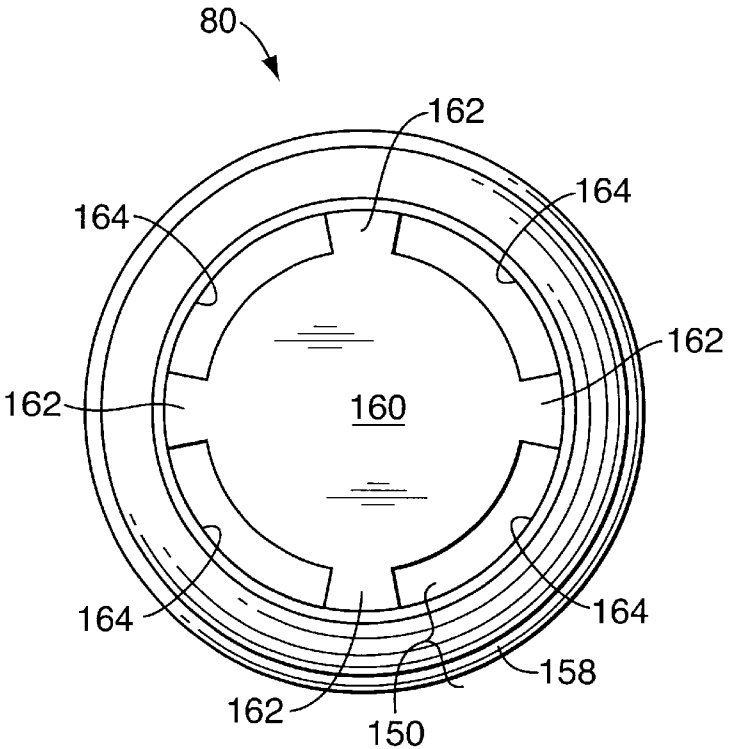
FIG. 5 is a top plan view of a retainer for mounting a resilient valve within a nozzle of the first embodiment of the dispensing closure shown in FIGS. 1–4.

The first embodiment of the dispensing system of the invention is illustrated in FIGS. 1–9 in the form of a dispensing closure 30 (FIG. 1) for a container (not illustrated). As can be seen in FIG. 3, the closure 30 has a body 32 which includes a hollow, generally cylindrical base or skirt 34, an annular shoulder 36 extending radially inwardly from the top of the skirt 34, and a reduced diameter spout 38 extending upwardly from the inner portion of the shoulder 36.

As can be seen in FIG. 3, the interior of the skirt 34 defines an internal, female thread 40. The skirt 34 is adapted to receive the upper end of a container mouth or neck (not illustrated). The skirt thread 40 is adapted to matingly engage a thread on the container mouth or neck.

Alternatively, the closure skirt 34 could be provided with some other container connecting means (not illustrated), such as a snap-fit bead or groove (not illustrated) in place of the thread 40 for engaging a mating groove or bead (not illustrated), respectively, in the container neck. The closure body 32 could also be permanently fixed to the container by means of induction melting, ultrasonic melting, gluing, or the like, depending on the materials used for the closure body 32 and the container. The closure body 32 could also be formed as a unitary part, or extension, of the container.

The closure body skirt 34 may have any suitable configuration. The container could have an upwardly projecting neck or other portion for being received within the particular configuration of the closure body 32, and the main part of the container may have a different cross-sectional shape than the container neck and closure body skirt 34.

The closure 30 is adapted to be used with a container having a mouth or other opening to provide access to the container interior and to a product contained therein. The product may be, for example, a liquid comestible product. The product could also be any other liquid, solid, or gaseous material, including, but not limited to, a powder, a cream, a food product, a personal care product, an industrial or household cleaning product, or other chemical compositions (e.g., compositions for use in activities involving manufacturing, commercial or household maintenance, construction, agriculture, etc.).

The container would typically be a squeezable container having a flexible wall or walls which can be grasped by the user and squeezed or compressed to increase the internal pressure within the container so as to force the product out of the container and through the closure 30. The container wall typically has sufficient, inherent resiliency so that when the squeezing forces are removed, the container wall returns to its normal, unstressed shape. Such a squeezable wall structure is preferred in many applications but may not be necessary or preferred in other applications. For example, in some applications it may be desirable to employ a generally rigid container and to pressurize the container interior at selected times with a piston or other pressurizing system.

An annular, "crab's claw" seal 42 projects downwardly from the underside of the body shoulder 36 as can be seen in FIGS. 1 and 3. The seal 42 is adapted to sealingly engage the upper, annular edge of the container (not illustrated) on which the closure 30 is mounted.

Figure 4:
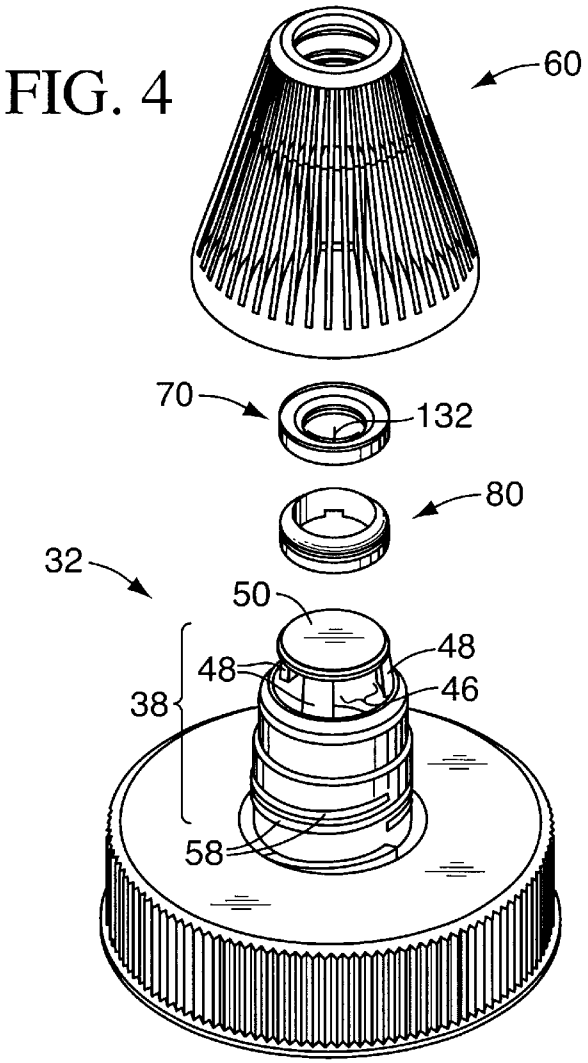
FIG. 4 is a perspective view of the exploded closure components shown in FIG. 3.

The preferred embodiment of the spout 38 has a generally circular, transverse cross section everywhere along its length, and the diameter of the base 34 is greater than the largest diameter of the spout 38. The spout 38 has an internal discharge passage 44 (FIG. 3) for communicating with the container interior. The spout 38 also has a distal end that includes at least one discharge aperture 46 (FIGS. 3 and 4)

that opens externally from the spout discharge passage 44. Preferably, there are three such apertures 46 with a strut 48 between each pair of adjacent apertures 46. Three such struts 48 which are arranged equidistantly around the end of the spout 38. The distal ends of each strut 48 support a disk 50 (FIGS. 3 and 4) located distally of the three apertures 46. As can be seen in FIG. 2, the disk 50 has an arcuate, peripheral, distal edge 52 which merges with a generally cylindrical, peripheral surface 54 which functions as a distal seal surface located distally of the discharge apertures 46. The size, shape, and number of apertures 46 and struts 48 may vary. The profile of the disk surfaces 52 and 54 may vary.

The spout 38 also has an exterior, proximal seal surface 56 (FIG. 3) located proximally of the discharge apertures 46. The proximal seal surface 56 is preferably cylindrical. The upper end of the proximal seal surface 56 terminates at the discharge apertures 46 in an annular bead 57 (FIG. 3).

Below the proximal seal surface 56 is an external, male thread 58 (FIGS. 3 and 4) around the base of the spout 38. Multiple lead threads may be employed. A cam surface could also be employed in place of a thread per se.

The dispensing closure body 32 is preferably molded from a thermoplastic material such as polypropylene to form a generally rigid, hard, plastic structure. The particular material from which the body 32 is molded forms no part of the present invention.

The dispensing closure 30 also includes a nozzle assembly, which in the first embodiment illustrated in FIG. 3, comprises a twist tip or nozzle 60, a valve 70, and a retainer or retention ring 80. The nozzle 60 is adapted to be mounted on the spout 38. The nozzle 60 includes an internal, female thread 84 (FIGS. 2 and 3) for engaging the spout thread 58. If the spout 38 employs a cam surface or cam instead of the thread 58 per se, then the nozzle 60 would have a suitable cam follower.

The inside of the nozzle 60 defines an internal dispensing passage 86 (FIG. 3) which is adapted to receive, and extend around, at least a portion of the spout 38 as shown in FIG. 1. The nozzle 60 can be rotated in threaded engagement on the spout 38 to effect axial movement of the nozzle 60 along the spout 38 between a lowered or retracted, closed position (FIG. 1) and an elevated or extended, open position (FIG. 2).

With reference to FIG. 3, the dispensing passage 86 of the nozzle 60 has a larger diameter lower portion 88 containing the thread 84. The nozzle 60 has a reduced diameter intermediate portion defining a proximal seal surface 90. At the bottom of the nozzle proximal seal surface 90 is an annular bead 92 (FIG. 3).

The upper end of the nozzle 60 preferably has a further reduced diameter upper portion defining a generally cylindrical distal seal surface 96 (FIG. 3) located axially outwardly of the nozzle proximal seal surface 90. The nozzle distal seal surface 96 and nozzle proximal seal surface 90 together define at least part of the nozzle dispensing passage 86.

Above the nozzle distal seal surface 96 is an internal, annular bead 95 (FIG. 3), and above the bead 95 is an internal, annular channel 97 (FIG. 3) for receiving the retainer ring 80 as shown in FIG. 1.

The nozzle 60 terminates at its upper, distal end in a dispensing opening 98 (FIG. 3). The nozzle 60 defines an annular seat 100 (FIG. 3) around the underside of the nozzle dispensing opening 98, and the seat 100 accommodates the location and retention of the valve 70 in the nozzle 60 as described hereinafter.

In the preferred embodiment illustrated, the valve 70 has the configuration and operating characteristics of a commercially available valve design substantially as disclosed in the U.S. Pat. No. 5,676,289 with reference to the valve 46 disclosed in the U.S. Pat. No. 5,676,289. The operation of such a type of valve is further described with reference to the similar valve that is designated by reference number 3*d* in the U.S. Pat. No. 5,409,144. The descriptions of those two patents are incorporated herein by reference thereto to the extent pertinent and to the extent not inconsistent herewith.

Figure 8:
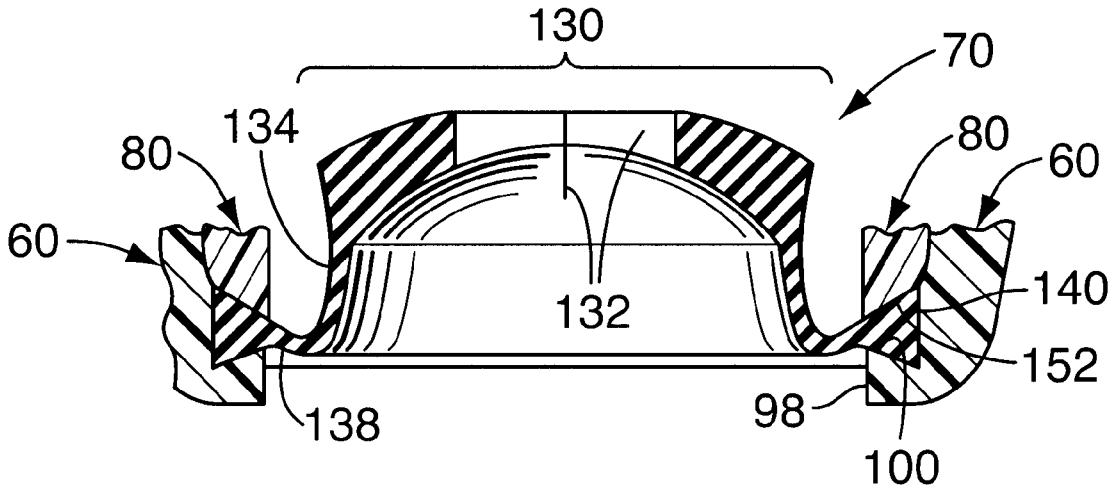
FIG. 8 is a greatly enlarged, fragmentary, cross-sectional view of the distal end of the dispensing closure shown in an inverted orientation prior to dispensing product from the container.
Figure 9:
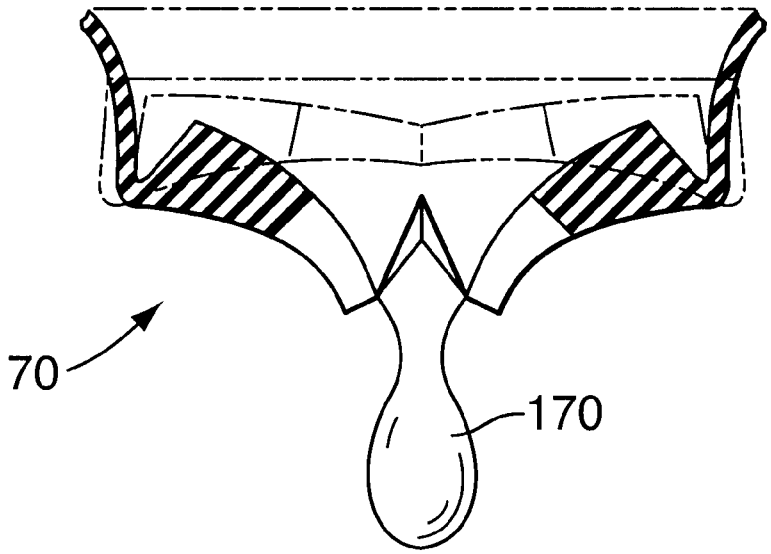
FIG. 9 is a view similar to FIG. 8, but FIG. 9 shows the valve in the distal end of the dispensing closure in a substantially fully opened configuration dispensing a product which is pressurized from the interior region adjacent the valve.

The valve 70 is flexible and changes configuration between (1) a closed, rest position (shown closed in an upright package in FIG. 2 and shown closed in an inverted package in FIG. 8) and (2) an active, open position (shown open in an inverted package in FIG. 9). The valve 70 includes a flexible, central portion, face, or head portion 130 (FIG. 8) which has an unactuated, concave configuration (when viewed from the exterior) and has two, mutually perpendicular, intersecting, dispensing slits 132 of equal length which together define a closed dispensing orifice. The intersecting slits 132 define four, generally sector-shaped, flaps or petals in the concave, central, head portion 130. The flaps open outwardly from the intersection point of the slits 132, in response to increasing container pressure of sufficient magnitude, in the well-known manner described in the U.S. Pat. No. 5,409,144.

The valve 70 includes a skirt or sleeve 134 which extends from the valve central wall or head portion 130. At the outer end of the sleeve 134, there is a thin, annular flange 138 which extends peripherally from the sleeve 134 in a reverse angled orientation. The thin flange 138 merges with an enlarged, much thicker, peripheral flange 140 which has a generally dovetail-shaped, transverse cross section (as viewed in FIG. 8).

To accommodate the seating of the valve 70 in the nozzle 60, the frustoconical configuration of the nozzle annular seat 100 has the same angle as the angle of the adjacent surface of the dovetail valve flange 140.

The other surface of the valve flange 140 is clamped by the retention ring 80 (FIG. 1). The retention ring 80 includes a peripheral portion or ring portion 150 (FIG. 5) having an upwardly facing, frustoconical, annular clamping surface 152 (FIGS. 1 and 5) for engaging the inner surface of the valve flange 140 at an angle which matches the angle of the adjacent surface of the valve flange dovetail configuration.

The peripheral portion 150 of the retention ring 80 includes an outwardly projecting shoulder or bead 158 (FIGS. 5 and 6) for snap-fit engagement with the bead 95 of the nozzle 60 (FIG. 1) to clamp the valve 70 tightly in the nozzle 60. This arrangement securely clamps and holds the valve 70 without requiring special internal support structures or bearing members adjacent the interior surface of the valve cylindrical sleeve 134. This permits the region adjacent the interior surface of the valve cylindrical sleeve 134 to be substantially open, free, and clear so as to accommodate movement of the valve sleeve 134 as described hereinafter.

The retaining ring 80 includes a flow restrictor in the form of a central occlusion disk 160 (FIGS. 1, 5, and 6) connected to the ring portion 150 by bridges 162 so as to define restricted flow openings 164 (FIG. 5) between the disk 160, ring portion 150, and bridges 162.

The valve 70 is a resiliently flexible, molded structure which is preferably molded from a thermosetting elastomeric material, such as silicone rubber, natural rubber, and the like. Preferably, the valve 70 is molded from silicone rubber, such as the silicone rubber sold by The Dow Chemical Company in the United States of America under the trade designation DC 94-595 HC. Such a valve is substantially inert so as to avoid reaction with, and/or adulteration of, the product being packaged. However, the valve 70 can also be molded from other thermosetting materials or from other elastomeric materials, or from thermoplastic polymers or thermoplastic elastomers, including those based upon materials such as thermoplastic propylene, ethylene, urethane, and styrene, including their halogenated counterparts.

The valve 70 could be molded with the slits 132. Alternatively, the valve slits 132 could be subsequently cut into the central head portion 130 of the valve 70 by suitable conventional techniques.

When the valve 70 is properly mounted within the nozzle 60 as illustrated in FIGS. 1 and 8, the central head portion 130 of the valve 70 lies recessed within the nozzle 60. However, when the package is squeezed to dispense the contents through the valve 70, then the valve head portion 130 is forced outwardly from its recessed position toward the end of the package and through the distal dispensing opening 98 (FIGS. 8 and 9).

The nozzle assembly (i.e., the nozzle 60, valve 70, and retaining ring 80) is adapted to be mounted on the spout 38 as shown in FIG. 1. The nozzle bead 92 and spout bead 57 have profiles which accommodate movement of the beads past each other as the spout and nozzle are assembled by being forced together. The nozzle 60 undergoes some temporary outward expansion or deformation so that the beads slide past each other. The nozzle threads 84 can then be screwed onto the spout threads 58, or the nozzle threads 84 may simply be forced or snapped onto the spout threads 58.

When the components are fully assembled and in the retracted, closed position as shown in FIG. 1, the nozzle central dispensing passage (passage 86 identified in FIG. 3) extends around at least a portion of the spout 38. The nozzle proximal seal surface bead 92 sealingly engages the spout proximal seal surface 56, and/or the spout proximal seal surface bead 57 sealingly engages the nozzle proximal seal surface 90. The nozzle distal seal surface 96 sealingly engages the spout distal seal surface 54. This occludes the spout discharge apertures 46 and prevents flow out of the spout 38.

In order to dispense product, the nozzle 60 is rotated on the spout 38 to move the nozzle to the elevated, open position as shown in FIG. 2. Then the package is inverted and squeezed. FIG. 8 shows orientation of a valve 70 when the package is first inverted before the container is squeezed. The container is then squeezed to increase the pressure within the container above the ambient exterior atmospheric pressure. This forces the product from the container toward the valve 70 and forces the valve 70 from the recessed or retracted position (FIG. 8) toward an outwardly extending position (shown in FIG. 9). The outward displacement of the central head portion 130 of the valve 70 is accommodated by the relatively thin, flexible sleeve 134. The sleeve 134 moves from an inwardly projecting, rest position (shown in FIG. 8) to an outwardly displaced, pressurized position, and this occurs by the sleeve 134 "rolling" along itself outwardly toward the outside end of the package (toward the position shown in solid lines in FIG. 9). However, the valve 70 does not open (i.e., the slits 132 do not open) until the valve central head portion 130 has moved substantially all the way to a fully extended position (FIG. 9). Indeed, as the valve head portion 130 begins to move outwardly, the valve head portion 130 is initially subjected to radially inwardly directed compression forces which tend to further resist opening of the slits 132. Also, the valve central head portion 130 generally retains its inwardly concave configuration as it moves outwardly and even after it reaches the fully extended position. However, if the internal pressure becomes sufficiently high after the valve central head portion 130 has moved outwardly to the fully extended position, then the slits 132 of the valve 70 open to dispense the fluent material (FIG. 9). The fluent material is then expelled or discharged through the open slits 132. For illustrative purposes, FIG. 9 shows a drop 170 of a liquid material being discharged.

Owing to the unique design, the dispensing of the fluent material from the nozzle assembly can be readily and accurately directed and controlled. The fluent material can be easily observed as it is discharged to a desired target area.

The above-discussed dispensing action of valve 70 typically would occur only after (1) the nozzle 60 has been moved to the open position (FIG. 2), (2) the package has been inverted, and (3) the container is squeezed. Pressure on the interior side of the valve 70 will cause the valve to open when the differential between the interior and exterior pressure reaches a predetermined amount. Depending on the particular valve design, the open valve 70 may close when the pressure differential decreases, or the valve may stay open even if the pressure differential decreases to zero. In the preferred embodiment of the valve 70 illustrated for the first embodiment of the system shown in FIGS. 1–9, the valve is designed to close when the pressure differential decreases to a predetermined amount.

When the squeezing pressure on the container is released, the valve 70 closes, and the valve head 130 retracts to its recessed, rest position within the nozzle 60. If the container is inverted while the valve 70 is closed, but the container is not being squeezed, then the weight of the fluent material on the valve 70 does not cause the valve 70 to open, or to remain open.

The nozzle assembly is prevented from being rotated beyond the full open condition (FIG. 2) and off of the spout 38 because of engagement of the nozzle bead 92 with the spout bead 57 (FIG. 2). However, in all positions of the nozzle 60, from fully closed (FIG. 1) to fully open (FIG. 2), the nozzle proximal seal surface bead 92 sealingly engages the spout proximal seal surface 56 and/or the spout proximal seal surface bead 57 sealingly engages the nozzle proximal seal surface 90. In all positions, the valve 70 remains located distally of the spout disk seal surface 54 and discharge apertures 46.

After some amount of product has been dispensed and the package is returned to its normal upright orientation (FIG. 2), residual fluid product in the space under the occlusion disk 160 and above the spout disk 50 will tend to flow downwardly in the nozzle into the container under the influence of gravity. In the preferred embodiment, the valve 70 closes when the squeezing force on the container is terminated. Also, fluid product in the space under the closed valve 70 and above the occlusion disk 160 will tend to flow, under the influence of gravity, downwardly in the nozzle 60 through the retainer ring restricted flow openings 164. The fluid product in the nozzle 60 will continue to flow downwardly around the spout disk 50, and then down the spout 38 and back into the container. A low viscosity liquid (e.g., water) will drain completely from the nozzle back into the container. The user may then want to rotate the nozzle 60 back down to the retracted, sealed closed configuration as shown in FIG. 1.

The present invention is also especially suitable for use with relatively high viscosity products that may not flow quickly back down into the container from the upper part of the nozzle 60 after a quantity of such product has been dispensed and the package returned to the upright position (FIG. 2). A portion of such a viscous or thick product, such as a lotion or thick food product such as mustard, could remain on top of the spout disk 50 below the elevated occlusion disk 160 (FIG. 2). As the nozzle 60 is rotated to move the nozzle 60 back down to the sealed closed configuration as shown in FIG. 1, the thick product will be squeezed by the downwardly moving disk 160. Most of the product is squeezed downwardly around the periphery of the spout disk 50, between the circumference of the spout disk 50 and the internal surfaces of the nozzle 60. Initially, and for most of the downward movement of the nozzle 60, the peripheral space between the circumference of the spout disk 50 and the internal surfaces of the nozzle 60 is greater than the space defined by the retainer ring restricted flow openings 164. Thus, as the viscous product is squeezed between the downwardly moving occlusion disk 160 and the spout disk 50, most of the product will be forced downwardly around the spout disk 50 into the container, and only a very small amount of the product will tend to be forced upwardly through the restricted flow openings 164. For a given product viscosity, the internal dimensions of the closure passages can be sized so that, as the nozzle 60 is moved to the completely closed position illustrated in FIG. 1, the amount of product squeezed upwardly through the restricted flow openings 164 will be insufficient to substantially deform the valve 70, and the valve 70 will remain in the inwardly concave position illustrated in FIG. 1 wherein the valve slits remain sealed closed. However, with some embodiments, a small amount of upward leakage through the closed valve might be acceptable to the user in some applications (e.g., a soap dispensing package used and kept in a shower or on a sink).

If the occlusion disk 160 was omitted, there is a likelihood that the closing of the nozzle 60 (after dispensing a relatively thick product) could squeeze the product against the interior surfaces of the valve 70 and cause the valve 70 to temporarily open a small amount so that an unacceptable quantity of product might undesirably accumulate on the exterior surface of the valve 70. Thus, the instant invention, which includes the occlusion disk 160 with surrounding restricted flow openings 164, substantially minimizes the pressurization of the underside of the valve 70 with viscous product as the nozzle 60 is rotated downwardly to the fully closed position (FIG. 1), and this eliminates, or greatly minimizes, the likelihood of the valve 70 being temporarily opened to release product as the nozzle 60 is being closed.

The occlusion disk 160 may also be characterized as a baffle which is operative between the valve 70 and the top of the spout 38 and which functions to dampen the "piston action" of the spout disk 50 relative to the downwardly moving nozzle 60. The baffle system, comprising the occlusion disk 160 and restricted flow openings 164, functions to increase resistance to upward flow so that the substantial portion of the viscous product tends to instead flow through the path of least resistance defined by the larger peripheral space between the circumference of the disk 50 and the internal surfaces of the nozzle 60.

During the operation of dispensing product from the container through the elevated nozzle 60 and out through the open slit valve 70, there must be sufficient pressure differential to open the valve 70, and maintain the valve 70 open, during the discharge. Thus, if the user squeezes the container to create an increased internal pressure, the flow rate of the product through the closure system, including the openings 164 around the disk 160 below the valve 70, will be accompanied by some pressure drop so that the pressure at the valve 70 per se is somewhat less than the pressure in the container. The system, including the openings 164 around the disk 160, must be sized so that the pressure drop through the closure does not cause the pressure at the valve 70 to decrease below the minimum pressure required to keep the valve to open (for a given constant ambient pressure on the exterior of the valve and a constant flow rate at given constant squeezing pressure within the container).

Preferably, in preferred embodiments of the invention, the opening height of the nozzle 60, from the full closed position illustrated in FIG. 1 to the full open position illustrated in FIG. 2, is minimized so as to minimize the volume between the interior of the valve 70 and the top of the spout 38, which volume is occupied by the viscous product as it is being dispensed and as the nozzle 60 is subsequently rotated back down to the fully closed position (FIG. 1).

A second embodiment of the present invention is illustrated in FIGS. 10–16. In the second embodiment, elements which are the same and/or functionally analogous to elements in the first embodiment illustrated in FIGS. 1–9 are designated with the same reference numbers as used in FIGS. 1–9, except that the second embodiment reference numbers are followed by the suffix letter "A."

Figure 10:
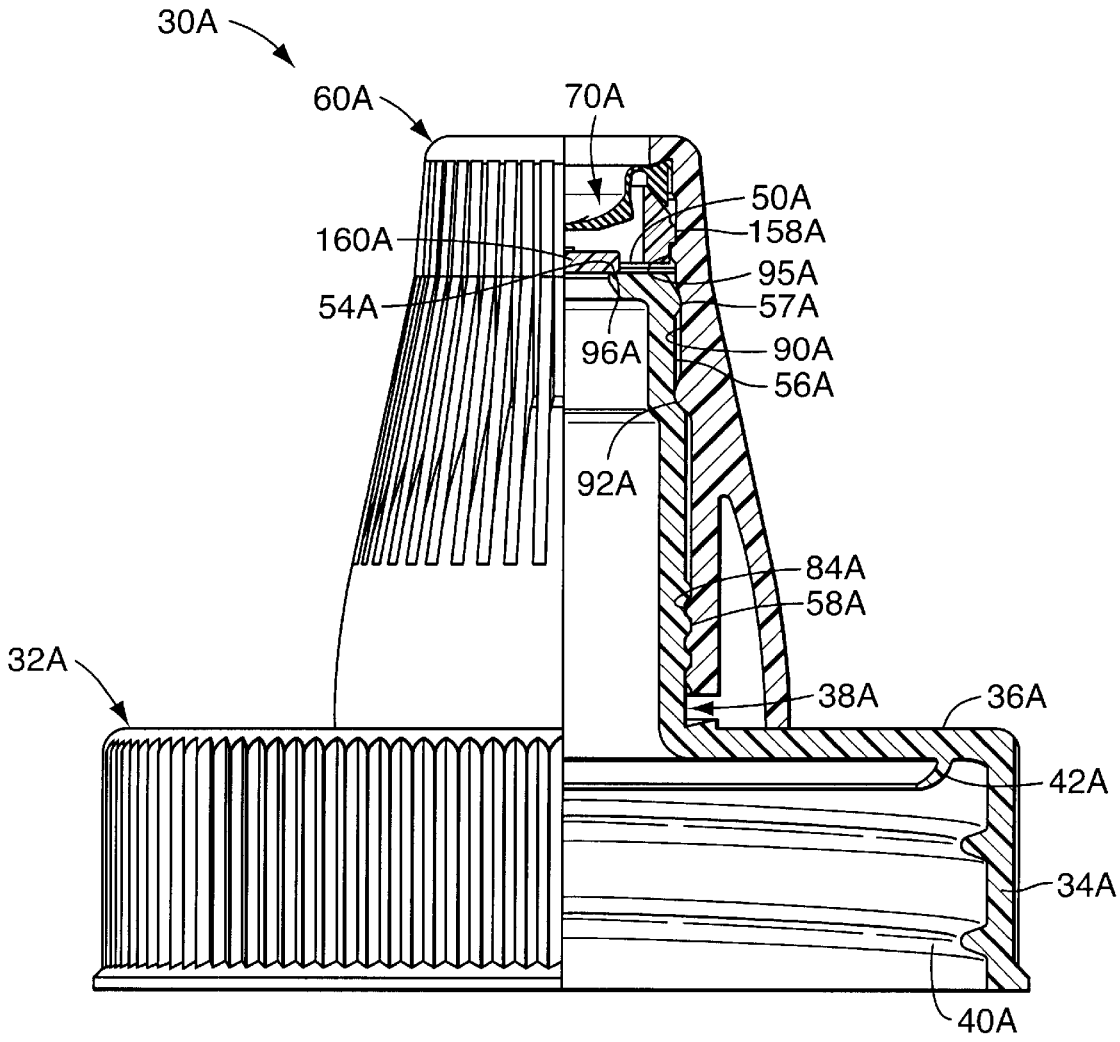
FIG. 10 is a partial, cross-sectional, side elevational view of a second embodiment of the dispensing system of the present invention as incorporated in a dispensing closure which is formed separately from, and which is adapted to be releasably mounted to, a container (not illustrated) that has an opening to the container interior, and the dispensing closure is shown with the components thereof in a closed condition.
Figure 12:
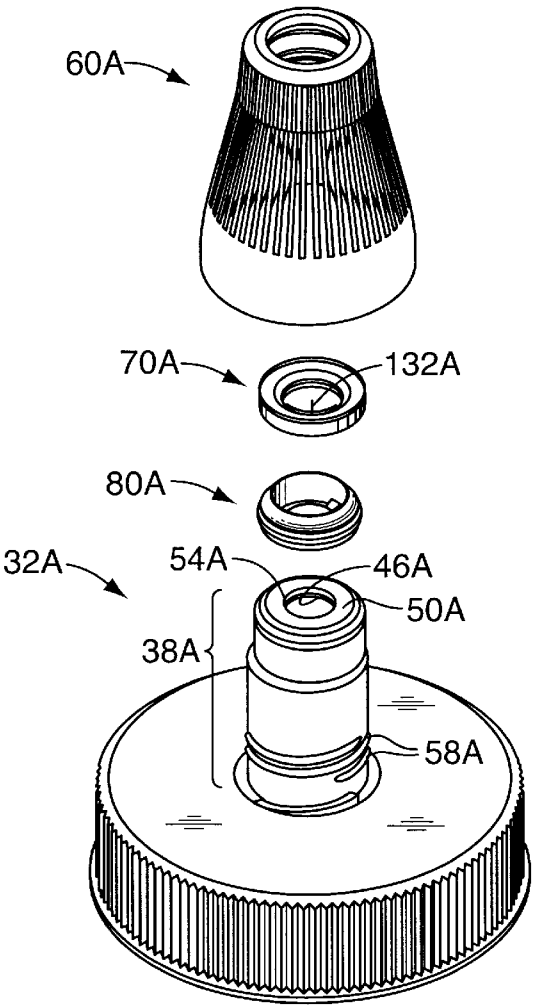
FIG. 12 is a perspective view of the exploded closure components shown in FIG. 11.
Figure 11:
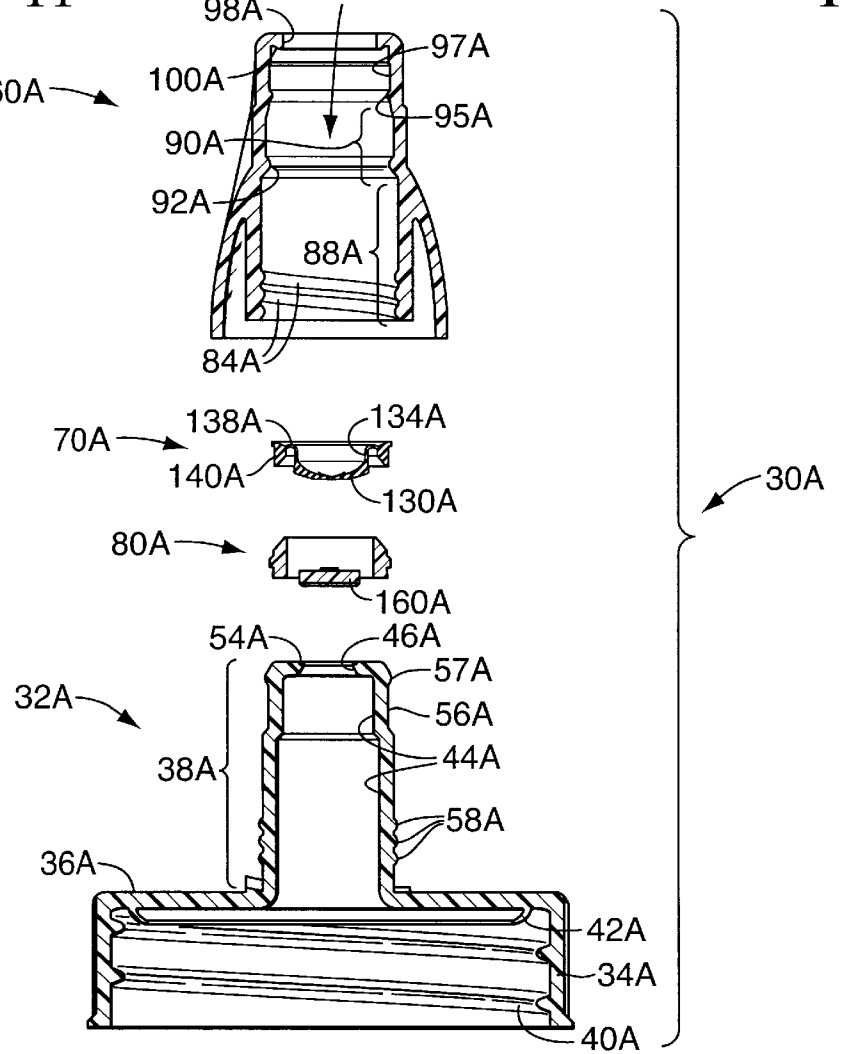
FIG. 11 is an exploded, cross-sectional view of the components of the dispensing closure shown in FIG. 10.

The second embodiment of the dispensing system of the invention is illustrated in FIGS. 10–16 in the form of a dispensing closure 30A (FIG. 10) for a container (not illustrated). As can be seen in FIG. 11, the closure 30A has a body 32A which includes a hollow, generally cylindrical base or skirt 34A, an annular shoulder 36A extending radially inwardly from the top of the skirt 34A, and a reduced diameter spout 38A extending upwardly from the inner portion of the shoulder 36A.

As can be seen in FIG. 11, the interior of the skirt 34A defines an internal, female thread 40A. The skirt 34A is adapted to receive the upper end of a container mouth or neck (not illustrated). The skirt thread 40A is adapted to matingly engage a thread on the container mouth or neck.

Alternatively, the closure skirt 34A could be provided with some other container connecting means (not illustrated), such as a snap-fit bead or groove (not illustrated) in place of the thread 40A for engaging a mating groove or bead (not illustrated), respectively, in the container neck. The closure body 32A could also be permanently fixed to the container by means of induction melting, ultrasonic melting, gluing, or the like, depending on the materials used for the closure body 32A and the container. The closure body 32A could also be formed as a unitary part, or extension, of the container.

The closure body skirt 34A may have any suitable configuration. The container could have an upwardly projecting neck or other portion for being received within the particular configuration of the closure body 32A, and the main part of the container may have a different cross-sectional shape than the container neck and closure body skirt 34A.

The closure 30A is adapted to be used with a container having the features described above with respect to the container for which the first embodiment of the closure 30 is adapted to be used.

An annular, "crab's claw" seal 42A projects downwardly from the underside of the body shoulder 36A as can be seen in FIGS. 10 and 11. The seal 42A is adapted to sealingly engage the upper, annular edge of the container (not illustrated) on which the closure 30A is mounted.

The preferred embodiment of the spout 38A has a generally circular, transverse cross section everywhere along its length, and the diameter of the base 34A is greater than the largest diameter of the spout 38A. The spout 38A has an internal discharge passage 44A (FIG. 11) for communicating with the container interior. The spout 38A also has a distal end that includes at least one discharge aperture 46A (FIGS. 11 and 12) that opens externally from the spout discharge passage 44A. Preferably, there is just one such aperture 46A.

The spout discharge aperture is defined in a deck 50A (FIGS. 10 and 12) across the top end of the spout 38A so that the discharge aperture 46A has a fixed geometry at a stationary location relative to the container. The deck 50A has a shallow, annular seal channel or seal groove 54A around the aperture 46A.

The spout 38A also has an exterior, proximal seal surface 56A (FIG. 11) located proximally of the discharge aperture 46A. The proximal seal surface 56A is preferably cylindrical. The upper end of the proximal seal surface 56A terminates in an annular bead 57A (FIG. 11).

Below the proximal seal surface 56A is an external, male thread 58A (FIGS. 11 and 12) around the base of the spout 38A. Multiple lead threads may be employed. A cam surface could also be employed in place of a thread per se.

The dispensing closure body 32A is preferably molded from a thermoplastic material such as polypropylene to form a generally rigid, hard, plastic structure. The particular material from which the body 32A is molded forms no part of the present invention.

The dispensing closure 30A also includes a nozzle assembly, which in the second embodiment illustrated in FIG. 11, comprises a twist tip or nozzle 60A, a valve 70A, and a retainer or retention ring 80A. The nozzle 60A is adapted to be mounted on the spout 38A. The nozzle 60A includes an internal, female thread 84A (FIGS. 10 and 11) for engaging the spout thread 58A. If the spout 38A employs a cam surface or cam instead of the thread 58A per se, then the nozzle 60A would have a suitable cam follower.

The inside of the nozzle 60 defines an internal dispensing passage 86A (FIG. 11) which is adapted to receive, and extend around, at least a portion of the spout 38A as shown in FIG. 10. The nozzle 60A can be rotated in threaded engagement on the spout 38A to effect axial movement of the nozzle 60A along the spout 38A between a lowered or retracted, closed position (FIG. 10) and an elevated or extended, open position (FIG. 13).

With reference to FIG. 11, the dispensing passage 86A of the nozzle 60A has a larger diameter lower portion 88A containing the thread 84A. The nozzle 60A has a reduced diameter intermediate portion defining a proximal seal surface 90A. At the bottom of the nozzle proximal seal surface 90A is an annular bead 92A (FIG. 11).

Figure 13:
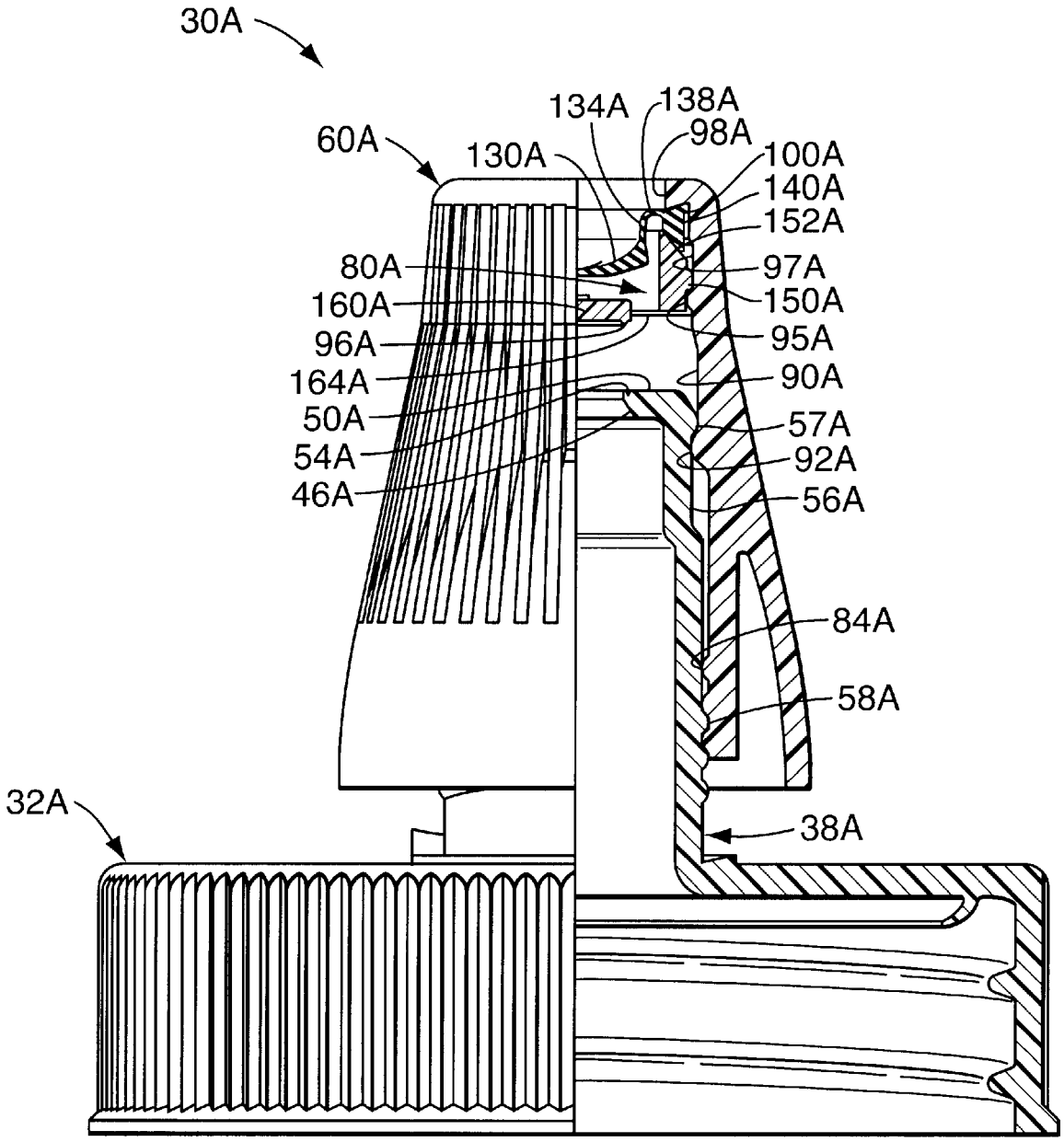
FIG. 13 is a view similar to FIG. 10, but FIG. 13 shows the dispensing closure with internal seal elements in an open condition.
Figure 16:
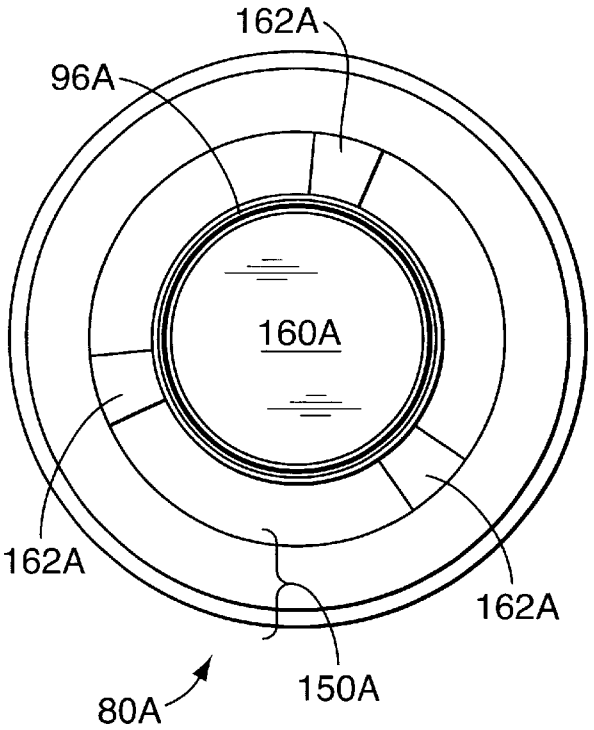
FIG. 16 is a bottom plan view of the retainer shown in FIGS. 14 and 15.

Above the nozzle proximal seal surface 90A is an internal, annular bead 95A (FIG. 11), and above the bead 95A is an internal, annular channel 97A (FIG. 11) for receiving the retainer ring 80A as shown in FIG. 13.

The nozzle 60A terminates at its upper, distal end in a dispensing opening 98A (FIG. 11). The nozzle 60A defines an annular seat 100A (FIG. 11) around the underside of the nozzle dispensing opening 98A, and the seat 100A accommodates the location and retention of the valve 70A in the nozzle 60A as described hereinafter.

In the preferred embodiment illustrated, the valve 70A has the configuration and operating characteristics of the valve 70 described above with reference to the first embodiment illustrated in FIGS. 1–9. The valve 70A includes a flexible, central portion, face, or head portion 130A (FIG. 11) which has an unactuated, concave configuration (when viewed from the exterior) and has two, mutually perpendicular, intersecting, dispensing slits 132A (FIG. 12) of equal length which together define a closed dispensing orifice. The intersecting slits 132A define four, generally sector-shaped, flaps or petals in the concave, central, head portion 130A The flaps open outwardly from the intersection point of the slits 132A, in response to increasing container pressure of sufficient magnitude.

The valve 70A includes a skirt or sleeve 134A (FIG. 11) which extends from the valve central wall or head portion 130A. At the outer end of the sleeve 134A, there is a thin, annular flange 138A which extends peripherally from the sleeve 134 in a reverse angled orientation. The thin flange 138A merges with an enlarged, much thicker, peripheral flange 140A which has a generally dovetail-shaped, transverse cross section (as viewed in FIG. 11).

To accommodate the seating of the valve 70A in the nozzle 60A, the frustoconical configuration of the nozzle annular seat 100A (FIG. 11) has the same angle as the angle of the adjacent surface of the dovetail valve flange 140A.

The other surface of the valve flange 140A is clamped by the retention ring 80A (FIG. 13). The retention ring 80A includes a peripheral portion or ring portion 150A (FIGS. 11 and 14) having an upwardly facing, frustoconical, annular clamping surface 152A (FIGS. 11 and 15) for engaging the inner surface of the valve flange 140A at an angle which matches the angle of the adjacent surface of the valve flange dovetail configuration.

The peripheral portion 150A of the retention ring 80A includes an outwardly projecting shoulder or bead 158A (FIGS. 10 and 15) for snap-fit engagement with the bead 95A of the nozzle 60A (FIG. 10) to clamp the valve 70A tightly in the nozzle 60A. This arrangement securely clamps and holds the valve 70A without requiring special internal support structures or bearing members adjacent the interior surface of the valve cylindrical sleeve 134A. This permits the region adjacent the interior surface of the valve cylindrical sleeve 134A to be substantially open, free, and clear so as to accommodate movement of the valve sleeve 134A as the valve 70A opens and closes.

The retainer or retaining ring 80A includes a flow restrictor in the form of a central occlusion disk 160A (FIGS. 11, 14, and 16) connected to the ring portion 150A by bridges 162A so as to define restricted flow openings 164A (FIG. 14) between the disk 160A, ring portion 150A, and bridges 162A.

Figure 15:
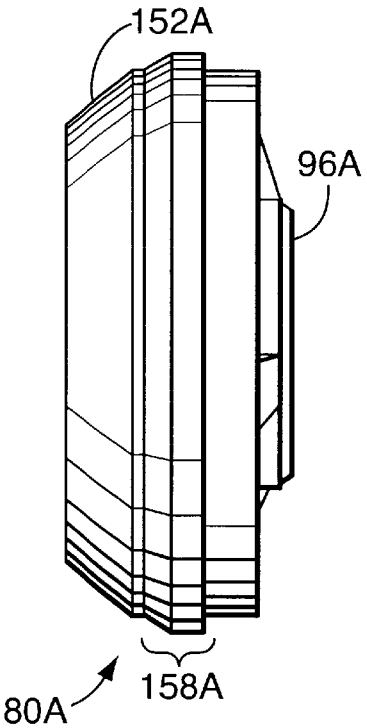
FIG. 15 is a side elevational view of the retainer shown in FIG. 14.
Figure 14:
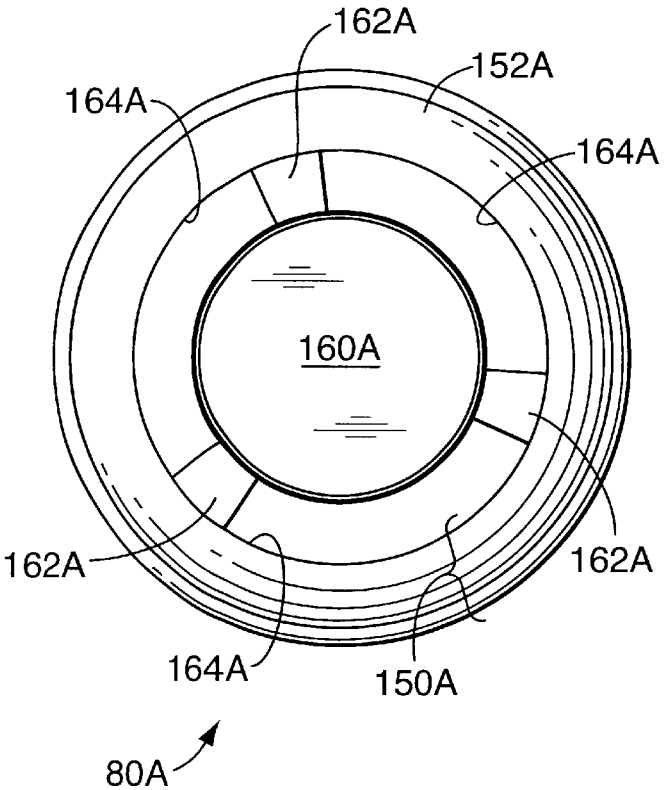
FIG. 14 is a top plan view of a retainer for mounting a resilient valve within a nozzle of the second embodiment of the dispensing closure shown in FIGS. 10–13.

As seen in FIGS. 13 and 15, an annular distal seal bead 96A projects downwardly from the bottom of the occlusion disk 160A for being received in the spout seal groove 54A when the nozzle assembly is in the retracted, lowered position (FIG. 10) so as to seal closed the spout aperture 46A.

In an alternate embodiment (not illustrated), the seal bead 96A could project upwardly on the spout deck 50A, and the seal groove 54A could be in the bottom of the occlusion disk 160A.

When the valve 70A is properly mounted within the nozzle 60A as illustrated in FIG. 13, the central head portion 130A of the valve 70A lies recessed within the nozzle 60A. However, when the package is squeezed to dispense the contents through the valve 70A, then the valve head portion 130A is forced outwardly from its recessed position toward the end of the package and through the distal dispensing opening 98A (FIG. 13).

The nozzle assembly (i.e., the nozzle 60A, valve 70A, and retainer or retaining ring 80A) is adapted to be mounted on the spout 3 8A as shown in FIG. 10. The nozzle bead 92A and spout bead 57A have profiles which accommodate movement of the beads past each other as the spout and nozzle are assembled by being forced together. The nozzle 60A undergoes some temporary outward expansion or deformation so that the beads slide past each other. The nozzle threads 84A can then be screwed onto the spout threads 58A.

When the components are fully assembled and in the retracted, closed position as shown in FIG. 10, the nozzle central dispensing passage (passage 86A identified in FIG. 11) extends around at least a portion of the spout 38A. The nozzle proximal seal surface bead 92A sealingly engages the spout proximal seal surface 56A, and/or the spout proximal seal surface bead 57A sealingly engages the nozzle proximal seal surface 90A. The nozzle distal seal bead 96A sealingly engages the spout distal seal groove 54A. This occludes the spout discharge aperture 46A and prevents flow out of the spout 38A.

In order to dispense product, the nozzle 60A is rotated on the spout 38A to move the nozzle to the elevated, open position as shown in FIG. 13. Then the package is inverted and squeezed to open the valve 70A in the same manner that the first embodiment valve 70 opens as described above with reference to FIGS. 1–9.

Owing to the unique design of the second embodiment, the dispensing of the fluent material from the nozzle assembly can be readily and accurately directed and controlled. The fluent material can be easily observed as it is discharged to a desired target area.

The above-discussed dispensing action of valve 70A typically would occur only after (1) the nozzle 60A has been moved to the open position (FIG. 13), (2) the package has been inverted, and (3) the container is squeezed. Pressure on the interior side of the valve 70A will cause the valve to open when the differential between the interior and exterior pressure reaches a predetermined amount. Depending on the particular valve design, the open valve 70A may close when the pressure differential decreases, or the valve may stay open even if the pressure differential decreases to zero. In the preferred embodiment of the valve 70A illustrated for the second embodiment of the system shown in FIGS. 10–16, the valve 70A is designed to close when the pressure differential decreases to a predetermined amount.

When the squeezing pressure on the container is released, the valve 70A closes, and the valve head 130A retracts to its recessed, rest position within the nozzle 60A. If the container is inverted while the valve 70A is closed, but the container is not being squeezed, then the weight of the fluent material on the valve 70A does not cause the valve 70A to open, or to remain open.

The nozzle assembly is prevented from being rotated beyond the full open condition (FIG. 13) and off of the spout 38A because of engagement of the nozzle bead 92A with the spout bead 57A (FIG. 13). However, in all positions of the nozzle 60A, from fully closed (FIG. 10) to fully open (FIG. 13), the nozzle proximal seal surface bead 92A sealingly engages the spout proximal seal surface 56A and/or the spout proximal seal surface bead 57A sealingly engages the nozzle proximal seal surface 90A. In all positions, the valve 70A remains located distally of the spout deck groove surface 54A and discharge aperture 46A.

After some amount of product has been dispensed and the package is returned to its normal upright orientation (FIG. 13), residual fluid product in the space under the occlusion disk 160A and above the spout deck 50A will tend to flow downwardly in the nozzle into the container under the influence of gravity. In the preferred embodiment, the valve 70A closes when the squeezing force on the container is terminated. Also, fluid product in the space under the closed valve 70A and above the occlusion disk 160A will tend to flow, under the influence of gravity, downwardly in the nozzle 60A through the retainer ring restricted flow openings 164A. The fluid product in the nozzle 60A will continue to flow downwardly over the spout deck 50A, and then down the spout 38A and back into the container. A low viscosity liquid (e.g., water) will drain completely from the nozzle 60A back into the container. The user may then want to rotate the nozzle 60A back down to the sealed closed configuration as shown in FIG. 10.

The present invention is also especially suitable for use with relatively high viscosity products that may not flow quickly back down into the container from the upper part of the nozzle 60A after a quantity of such product has been dispensed and the package returned to the upright position (FIG. 13). A portion of such a viscous or thick product, such as a lotion or thick food product such as mustard, could remain on top of the spout deck 50A below the elevated occlusion disk 160A (FIG. 13). As the nozzle 60A is rotated to move the nozzle 60A back down to the sealed closed configuration as shown in FIG. 10, the thick product will be squeezed by the downwardly moving disk 160A. Most of the product is squeezed downwardly through the spout aperture 46A back into the container. Initially, and for most of the downward movement of the nozzle 60A, the peripheral space between the aperture 46A in the deck 50A and the nozzle occlusion disk 160A is greater than the space defined by the retainer ring restricted flow openings 164A. Thus, as the viscous product is pushed by the downwardly moving occlusion disk 160A, most of the product will be forced downwardly through the spout aperture 46A into the container, and only a very small amount of the product will tend to be forced upwardly through the restricted flow openings 164A. For a given product viscosity, the internal dimensions of the closure passages can be sized so that, as the nozzle 60A is moved to the completely closed position illustrated in FIG. 13, the amount of product squeezed upwardly through the restricted flow openings 164A will be insufficient to substantially deform the valve 70A, and the valve 70A will remain in the inwardly concave position illustrated in FIG. 13 wherein the valve slits remain sealed closed. However, with some embodiments, a small amount of upward leakage through the closed valve might be acceptable to the user in some applications (e.g., a soap dispensing package used and kept in a shower or on a sink).

If the occlusion disk 160A was omitted, there is a likelihood that the closing of the nozzle 60A (after dispensing a relatively thick product) could squeeze the product against the interior surfaces of the valve 70A and cause the valve 70A to temporarily open a small amount so that an unacceptable quantity of product might undesirably accumulate on the exterior surface of the valve 70A. Thus, the instant invention, which includes the occlusion disk 160A with surrounding restricted flow openings 164A, substantially minimizes the pressurization of the underside of the valve 70A with viscous product as the nozzle 60A is rotated downwardly to the fully closed position (FIG. 10), and this eliminates, or greatly minimizes, the likelihood of the valve 70A being temporarily opened to release product as the nozzle 60A is being closed.

The occlusion disk 160A may also be characterized as a baffle which is operative between the valve 70A and the top of the spout 38A and which functions to dampen the "piston action" of the spout deck 50A relative to the downwardly moving nozzle 60A. The baffle system, comprising the occlusion disk 160A and restricted flow openings 164A, functions to increase resistance to upward flow so that the substantial portion of the viscous product tends to instead flow through the path of least resistance defined by the larger open region below the disk 160A and by the spout aperture 46A.

During the operation of dispensing product from the container through the elevated nozzle 60A and out through the open slit valve 70A, there must be sufficient pressure differential to open the valve 70A, and maintain the valve 70A open, during the discharge. Thus, if the user squeezes the container to create an increased internal pressure, the flow rate of the product through the closure system, including the openings 164A around the disk 160A below the valve 70A, will be accompanied by some pressure drop so that the pressure at the valve 70A per se is somewhat less than the pressure in the container. The system, including the openings 164A around the disk 160A, must be sized so that the pressure drop through the closure does not cause the pressure at the valve 70A to decrease below the minimum pressure required to keep the valve to open (for a given constant ambient pressure on the exterior of the valve and a constant flow rate at given constant squeezing pressure within the container).

Preferably, the opening height of the nozzle 60A, from the full closed position illustrated in FIG. 10 to the full open position illustrated in FIG. 13, is minimized so as to minimize the volume between the interior of the valve 70A and the top of the spout 38A, which volume is occupied by the viscous product as it is being dispensed and as the nozzle 60A is subsequently rotated back down to the fully closed position (FIG. 10).

If desired, the nozzle assembly may be provided with an attached, or completely removable, lid (not illustrated) to protect the valve 70 or 70A against damage and/or to keep out dust and dirt. Such lid may be hinged to the nozzle assembly with a conventional or special snap-action hinge, or the lid may simply be tethered to the nozzle assembly. The lid may also include an inwardly extending plug or member for being received in the concave region of the valve 70 or 70A as a means for sealing the valve 70 or 70A—even when the nozzle 60 or 60A is in the elevated position—during handling when the package could be subjected to exterior forces that could cause internal, transient pressure increases that might otherwise open the valve.

In still another contemplated modification, a releasable seal or removable label (not illustrated) could be initially attached across the top of the nozzle assembly. After such a removable liner has been removed by the user, it could be saved by the user and later re-applied to the top of the closure (e.g., when the user subsequently wants to stow the package in luggage while traveling). This would prevent damage to the valve and/or prevent dust and dirt from settling on the valve.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing system for dispensing a product from a container having an opening, said system comprising:

a spout for communicating with said container opening and defining (1) at least one discharge aperture having a fixed geometry at a stationary location relative to said container, and (2) a distal seal surface located distally of said discharge aperture relative to said container;

a nozzle assembly which is mounted on said spout for movement between a retracted, closed position and an extended, open position, and which includes (A) a nozzle having (1) a dispensing passage around at least a portion of said spout, (2) a distal seal surface for sealingly engaging said spout distal seal surface when said nozzle assembly is in said retracted, closed position;

(B) a resiliently flexible valve that (1) is sealingly disposed across said nozzle dispensing passage at a location distally of said spout distal seal surface, and (2) has an initially closed dispensing orifice which opens in response to a pressure differential acting across said valve; and (C) a flow restrictor that is disposed across said nozzle dispensing passage at a location between said valve and said nozzle distal seal surface to restrict flow toward said valve as said nozzle assembly is moved to said retracted, closed position.

2. The dispensing system in accordance with claim 1 in which said spout defines a proximal seal surface located on the exterior of said spout proximally of said discharge aperture; and said nozzle defines a proximal seal surface for sealingly engaging said spout proximal seal surface.

3. The dispensing system in accordance with claim 2 in which said nozzle proximal seal surface includes (1) a generally cylindrical seal surface, and (2) a radially inwardly projecting seal bead adjacent, and merging with, said nozzle cylindrical seal surface;

said spout proximal seal surface includes (1) a radially outwardly projecting seal bead, and (2) a generally cylindrical seal surface adjacent, and merging with, said spout seal bead;

said spout has a distal end that includes a disk located distally of said discharge aperture;

said disk has an arcuate, peripheral, distal edge merging with a generally cylindrical, peripheral surface which defines said spout distal seal surface; and a portion of said nozzle between said valve and said nozzle proximal seal surface has a generally cylindrical interior surface which defines said nozzle distal seal surface for sealingly engaging said spout disk peripheral surface.

4. The dispensing system in accordance with claim 2 in which said nozzle dispensing passage is defined at least in part by said nozzle distal seal surface and said nozzle proximal seal surface;

said spout defines an internal discharge passage which communicates with said container opening and with said spout discharge aperture;

said spout has a distal end defining said spout distal seal surface;

said spout discharge aperture is adjacent said spout distal end; and said nozzle dispensing passage, said nozzle distal seal surface, and said spout distal seal surface are configured relative to said spout discharge aperture so as to establish communication between said valve and said spout discharge aperture only when said nozzle assembly is moved away from said retracted, closed position.

5. The dispensing system in accordance with claim 1 in which said system includes a hollow base for mounting to said container over said container opening; and said spout extends from said base.

6. The dispensing system accordance with claim 1 in which said valve is a self-closing valve;

said valve opens outwardly when the pressure against the side of the valve exposed to the container opening exceeds the pressure acting against the side of the valve exposed to ambient atmosphere by a predetermined amount; and said valve returns from an open condition to a closed condition after the pressure acting on the side of the valve exposed to the container opening decreases.

7. The dispensing system in accordance with claim 1 in which said container has an external, male thread;

said system is a dispensing closure that is separate from, but releasably attachable to, said container around said container opening;

said system includes a body having a hollow, generally cylindrical base which has an internal, female thread for threadingly engaging said male thread on said container;

said spout extends from said hollow base;

said spout has an external, male thread; and said nozzle has an internal, female thread for engaging said spout external, male thread.

8. The dispensing system in accordance with claim 1 in which said valve has an annular flange;

said nozzle has a distal end with a radially inwardly directed flange defining an annular seat facing the interior of said nozzle; and said nozzle assembly includes a retainer having a ring portion engaged with said nozzle to retain said valve in said nozzle with said valve annular flange clamped by said retainer against said nozzle annular seat; and said flow restrictor is formed as a unitary part of said retainer and includes a central occlusion disk connected to said ring portion by bridges so as to define restricted flow openings between said disk, said ring portion, and said bridges.

9. The dispensing system in accordance with claim 8 in which said retainer ring portion is a generally annular ring which is in a snap-fit engagement with said nozzle;

said nozzle includes an internal, annular channel;

said retainer annular ring portion includes a peripheral portion adapted to be received in said channel in a snap-fit engagement;

said valve annular flange has a dovetail cross section defining a frustoconical outer surface and a frustoconical inner surface;

said nozzle has a central opening surrounded by said nozzle annular seat;

said nozzle annular seat is a frustoconical seat engaging said frustoconical outer surface of said valve annular flange; and said retainer ring portion has a frustoconical clamping surface engaging said frustoconical inner surface of said valve annular flange to clamp said valve annular flange between said retainer and said nozzle annular seat.

10. The dispensing system in accordance with claim 1 in which said spout discharge aperture is one of a plurality of identical discharge apertures that are radially oriented.

11. A dispensing system for dispensing a product from a container having an opening, said system comprising:

a spout for communicating with said container opening and having a deck defining at least one discharge aperture having a fixed geometry at a stationary location relative to said container;

a nozzle assembly which is mounted on said spout for movement between a retracted, closed position and an extended, open position, and which includes a nozzle having a dispensing passage around at least a portion of said spout;

a resiliently flexible valve that (1) is sealingly disposed across said nozzle dispensing passage at a location distally of said spout discharge aperture, and (2) has an initially closed dispensing orifice which opens in response to a pressure differential acting across said valve; and a flow restrictor that is disposed across said nozzle dispensing passage at a location between said valve and said spout deck discharge aperture;

a distal seal groove defined on one of said spout deck and said nozzle assembly; and a distal seal bead defined on the other of said spout deck and nozzle assembly for sealingly engaging said distal seal groove when said nozzle assembly is in said retracted, closed position.

12. The dispensing system in accordance with claim 11 in which said spout defines a proximal seal surface located on the exterior of said spout proximally of said discharge aperture; and said nozzle defines a proximal seal surface for sealingly engaging said spout proximal seal surface.

13. The dispensing system in accordance with claim 12 in which said nozzle proximal seal surface includes (1) a generally cylindrical seal surface, and (2) a radially inwardly projecting seal bead adjacent, and merging with, said nozzle cylindrical seal surface; and said spout proximal seal surface includes (1) a radially outwardly projecting seal bead, and (2) a generally cylindrical seal surface adjacent, and merging with, said spout seal bead.

14. The dispensing system in accordance with claim 12 in which said nozzle dispensing passage is defined at least in part along said nozzle proximal seal surface;

said spout defines an internal discharge passage which communicates with said container opening and with said spout discharge aperture;

said spout has a distal end defining said distal seal groove;

said spout discharge aperture is at said spout distal end; and said nozzle dispensing passage, said distal seal bead, and said distal seal groove are configured relative to said spout discharge aperture so as to establish communication between said valve and said spout discharge aperture only when said nozzle assembly is moved away from said retracted, closed position.

15. The dispensing system accordance with claim 11 in which said valve is a self-closing valve;

said valve opens outwardly when the pressure against the side of the valve exposed to the container opening exceeds the pressure acting against the side of the valve exposed to ambient atmosphere by a predetermined amount; and said valve returns from an open condition to a closed condition after the pressure acting on the side of the valve exposed to the container opening decreases.

16. The dispensing system in accordance with claim 11 in which said container has an external, male thread;

said system is a dispensing closure that is separate from, but releasably attachable to, said container around said container opening;

said system includes a body having a hollow, generally cylindrical base which has an internal, female thread for threadingly engaging said male thread on said container;

said spout extends from said hollow base;

said spout has an external, male thread; and said nozzle has an internal, female thread for engaging said spout external, male thread.

17. The dispensing system in accordance with claim 11 in which said valve has an annular flange;

said nozzle has a distal end with a radially inwardly directed flange defining an annular seat facing the interior of said nozzle; and said nozzle assembly includes a retainer having a ring portion engaged with said nozzle to retain said valve in said nozzle with said valve annular flange clamped by said retainer against said nozzle annular seat; and said flow restrictor is formed as a unitary part of said retainer and includes a central occlusion disk connected to said ring portion by bridges so as to define restricted flow openings between said disk, said ring portion, and said bridges.

18. The dispensing system in accordance with claim 17 in which said retainer ring portion is a generally annular ring which is in a snap-fit engagement with said nozzle;

said nozzle includes an internal, annular channel; and said retainer annular ring portion includes a peripheral portion adapted to be received in said channel in a snap-fit engagement;

said valve annular flange has a dovetail cross section defining a frustoconical outer surface and a frustoconical inner surface;

said nozzle has a central opening surrounded by said nozzle annular seat;

said nozzle annular seat is a frustoconical seat engaging said frustoconical outer surface of said valve annular flange; and said retainer ring portion has a frustoconical clamping surface engaging said frustoconical inner surface of said valve annular flange to clamp said valve annular flange between said retainer and said nozzle annular seat.

19. The dispensing system in accordance with claim 11 in which said spout discharge aperture is a single, generally circular opening.

20. The dispensing system in accordance with claim 11 in which said system includes a hollow base for mounting to said container over said container opening; and said spout extends from said base.

* * * * *